US005931470A

United States Patent [19]

Smith

[11] Patent Number: 5,931,470

[45] Date of Patent: Aug. 3, 1999

[54] BOARD GAME USING PROPORTIONAL PATHS

[76] Inventor: Rebecca H. Smith, 3301 SW. 13th St. Apt. K201, Gainesville, Fla. 32608

[21] Appl. No.: 09/015,923

[22] Filed: Jan. 30, 1998

[51] Int. Cl.[6] ..... A63F 3/00

[52] U.S. Cl. ..... 273/248

[58] Field of Search ..... 273/242, 243, 273/248, 249, 246

[56] References Cited

U.S. PATENT DOCUMENTS

| | | | |
|---|---|---|---|
| 2,010,209 | 8/1935 | Willman | 273/248 |
| 4,560,170 | 12/1985 | Enyi | 273/248 |
| 4,984,805 | 1/1991 | Medlock | 273/248 |
| 5,102,339 | 4/1992 | Parriera | 273/248 X |
| 5,356,153 | 10/1994 | Morse | 273/248 |
| 5,826,876 | 10/1998 | Wagner | 273/248 X |
| 5,833,239 | 11/1998 | Eleidjian | 273/248 |

*Primary Examiner*—William E. Stoll
*Attorney, Agent, or Firm*—Sven W Hanson

[57] ABSTRACT

A game of chance and skill is provided utilizing a novel game board having multiple paths of varying length. Multiple decks of cards are provided each associated with a path on the game board. The number of cards from each deck in play is generally proportional to the length of each decks associated path. The structure of the game elements and methods of play is to provide relatively similar probabilities of movement along each of the paths. Linking elements between individual steps of each path lead to adjacent paths. Multiple possible courses of travel are defined by sequences of path steps and linking elements. In a preferred embodiment, the decks each have a number of cards which is a multiple of seven. Chance devices such as dice are also used. Various alternative methods are also provided including computer implementation of the game elements and methods of play.

9 Claims, 3 Drawing Sheets

BOARD GAME USING PROPORTIONAL PATHS

BACKGROUND OF THE INVENTION

The present invention is a board game using cards, chance devices and complex and varying movement paths. Traditional board games can be generally categorized into games principally of chance and games of skill or intelligence. A disadvantage of chance games is a lack of stimulation for those persons who enjoy a high level of intellectual competition. Conversely, games requiring high levels of skill or knowledge are typically not enjoyed by the novice or by those not well practiced in games. Additionally, high skill games do not accommodate skilled and novice players competing together. Where skill is required, skill players will too easily dominate. The present invention provides a game and methods of play which incorporate a blend of chance, skill, and teaming elements which is uniquely suited and enjoyable to a mix of skilled and unskilled players.

SUMMARY OF THE INVENTION

It is an object of the present invention to provide a novel game of skill and chance which uses a multitude of playing paths each having a unique length and each having a unique associated set of playing cards.

It is also an object of the present invention to provide a game having a multitude of paths to be traveled, each having a unique length, and associated playing elements which provide a probability of movement along each path that is relatively proportional to the length of each path.

It is yet another object of the invention to provide a board game utilizing multiple decks of cards, each having a number of cards which is a multiple of seven and each of which is associated with a path to be traveled in play.

It is a further object of the invention to provide a game having a multitude of unequal paths which are linked in a nonuniform and complex manner to create a greater number of complex courses from a start to finish thereby providing opportunities for skill expression in play.

It is also an object of the present invention to provide methods of playing in which all the players are alternatively teamed with each other player in attempting to traverse a multitude of paths to a goal.

The present invention is a game in which a multitude of paths to be traversed are matched with an equal number of decks of playing cards. The paths are of varying lengths requiring a varying number of steps or movements to complete travel along a course from a start to a finish. The varying lengths of the paths are balanced by a proportionate number of cards in each deck being used in play to determine movement along the path. This balance, together with other elements provide relatively equal probability of traversing each path to the finish. Preferably, seven paths are graphically presented on a traditional game board in a semicircular arrangement. Each step or increment of each path has linking elements which create a movement link to steps of each adjacent path. The semicircular configuration of the preferred game board provides steps of adjacent paths with side-by-side but offset bounds such that the linking elements may be easily and simply introduced and also understood during play. A course of travel during play follows both path steps and movement links. Seven matching decks of playing cards are provided. Indicia such as a symbol or color is provided on both the paths and cards to indicate the association of each. The playing cards of each deck are preferably ranked in sequences from one to seven. An essential element of the game is the overall probability of movement along a path is generally proportional to the length of the path. Probability of movement is a function of the number of associated cards in play, the rank of cards in play, and chance device outcome. These probabilities vary during a game as a consequence of play. Skillful play and travel through the paths requires recognizing the mathematical probabilities resulting from the combination of overall probabilities and variations caused by play and relative opponent positioning. A chance device such as a number of dice, having indicia associating each with a path, is used to increase the number of cards in play, thereby altering the probabilities in effect. In alternative configurations the paths are not spatially contiguous but are placed distant with linking information provided on each path or step.

In the methods of play provided, a selected number cards (proportional to the length of the paths) from each of the multiple decks are combined for play. These are mixed and distributed evenly among the players. The cards are played in hands with tricks won by the first played highest ranking card, with a particular suit having dominance regardless of rank (in the same manner as a trump suit in the card game bridge). The winning players move play pieces over the game paths as determined by the number and suit of the winning hands. The winning players move following linking elements from their current path to the path having the present dominant suit and then advance the appropriate number distance or steps. The number of steps of movement are reduced by a set minimum of tricks which must be overcome. Opportunity for use of skill is provided in the selection of the dominant suit with respect to the position on the playing paths, effective probabilities of movement, and knowledge of the cards in play. During each hand, the starter player, who selects the dominant suit, plays against the remaining players who play as a team. A different player selects the dominant suit in each hand such that the team composition changes with each hand. In this manner, the advantage of skilled players is alternatively shared with unskilled players. Hands are played until all of the cards have been used. The deck is then reassembled and play continues until a player completes travel to the finish of a path. During the course of travel, a player may move from one path to another and back again as the hands are won and lost in various suits.

In one method of play, each deck is divided into a playing deck and a residual deck. The playing decks are combined to create the playing hands. The residual decks are retained separate. As play commences, the player selecting the dominant suit is provide an opportunity to use chance pieces such as dice. The outcome of the dice determines a number of cards the player selects from the appropriate residual deck of dominant suit cards. In this manner, the player's hand is improved.

Although the game is preferably played on a traditional two dimensional game board, alterative play structures and methods are provided such as paths presented on a computer display device. Other objects, alternative game elements, and methods of play utilizing the same novel features of the invention are possible. The novel features of the claimed game and methods of play are better understood by referring to the examples provided below.

DESCRIPTION OF THE PREFERRED EMBODIMENTS

The game of the present invention focuses on a multitude of paths through which a course is traversed. Each path consists of a sequence of steps or stations leading from a start position to an end position. The novel properties of the game and play methods are a result, in part, of the varying lengths of the paths. Specifically, each path contains a different and unique number of steps between the start and end positions. Each step also contains linking elements which indicate a possible redirection of the course to adjacent steps of other paths. A complete course of movements is defined by a sequence of path steps and linking elements. The object of the game is to manipulate play such that a player traverses a course from the start position to the end position before the opposing players can do the same.

The game also includes a multitude of decks of playing elements such as playing cards. Each deck is identified by a differentiating and identifying characteristic. This may be a color, a specific graphic, or discrete indicia. In play, the identifying characteristic is used to indicate a suit in the manner of traditional card games. Each deck is associated with a single game path which shares the deck's identifying characteristic or suit. The number of cards in each deck may be the same or different than the number in every other deck. The cards also contain indicia indicating rank in sequence such as in a deck of traditional playing cards. By withdrawing cards from all decks, a playing set of cards is defined. The number of cards drawn from each deck is generally proportional to the number of steps or stations of the associated path. Consequently, the playing set will contain varying numbers of cards from the decks. During play, the playing set is assembled and dealt to two or more players. The cards are then played in a sequence of tricks, one against the other in the traditional manner such as in the game known as "bridge". The winning of tricks determines the movement of each player through the paths. In each hand of play, one suit of the decks is declared "trump" and is dominant in play over other suits. In one mode of play, a chance device such as a group of dice is used to enable a player to improve his hand with respect to trump cards.

Figure 1:
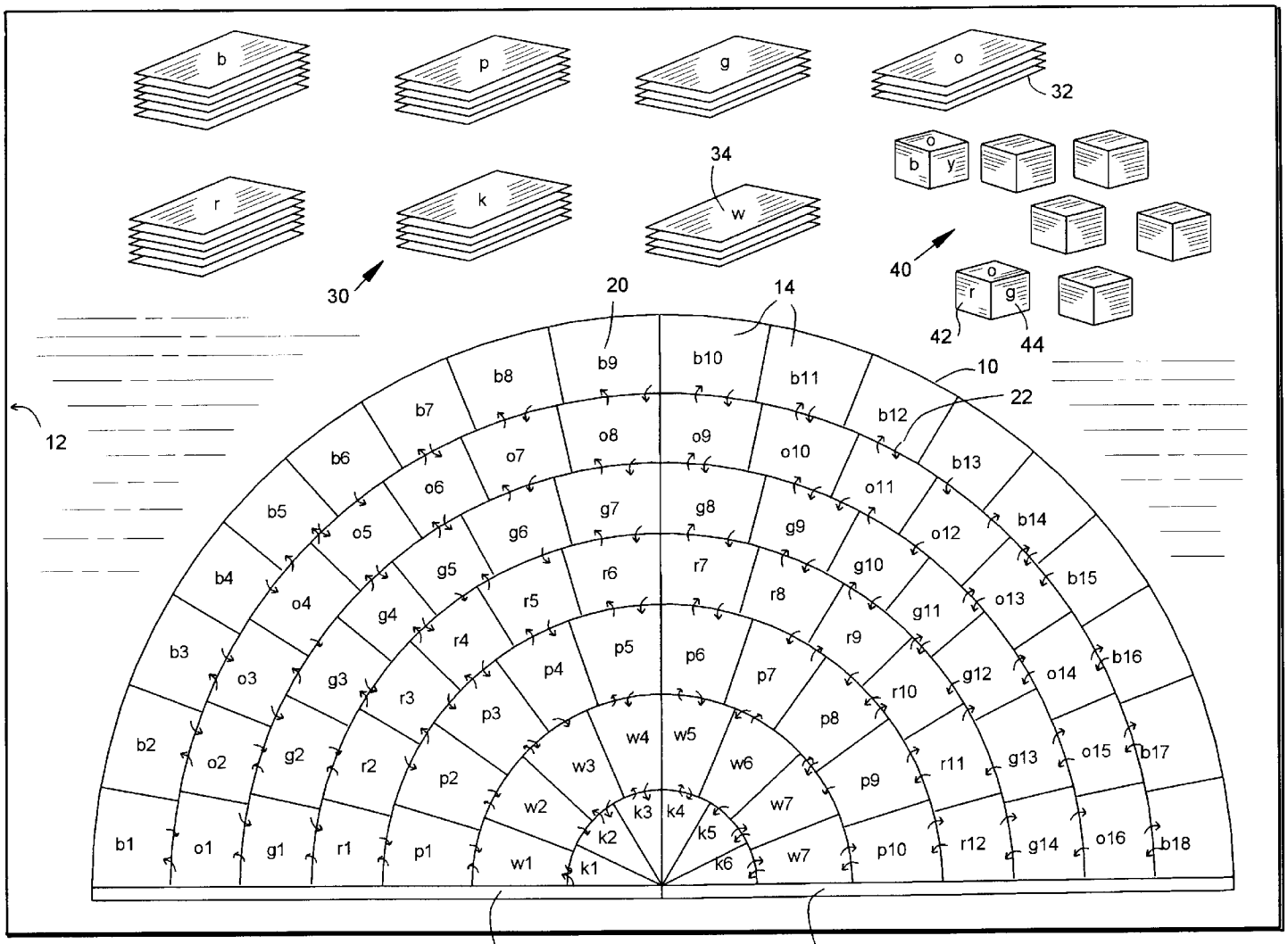
FIG. 1 depicts elements of a preferred embodiment of the novel board game.
Figure 2:
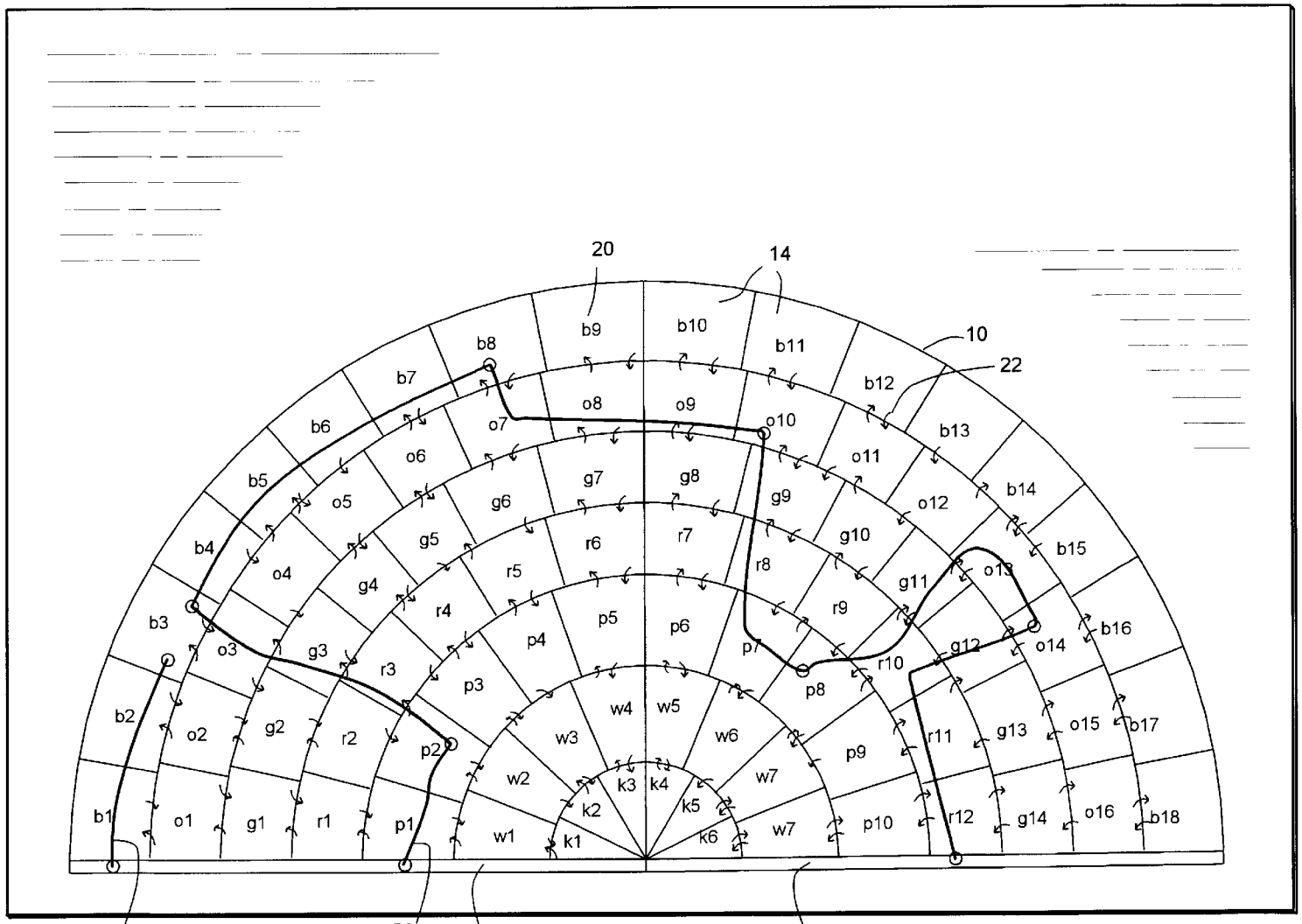
FIG. 2 depicts example movements along a course through paths on a game board of the invention.

The elements of the game and their interrelation are best described with respect to FIGS. 1 and 2 which depict a preferred embodiment of the game. Multiple paths 10 are presented on a game board 12. The paths 10 are in a semicircular configuration to accommodate the varying lengths of the different paths 10. Here, seven paths 10 are provided having from six to eighteen steps 14 from a start point 16 to an ending point 18. Each path 10 is labeled with a unique indicia 20 (shown within each step of the path). In the figure, the indicia 20 indicates a color (k: black, w: brown, p: purple, r: red, g: green, o: orange, b: blue). The "blue" path 10 being defined by the steps "b1" through "b18". The indicia 20 include numbers solely to indicate the sequential movement and direction along the path. Linking elements are provided as movement arrows 22. These movement arrows 22 indicate the possible routes between steps 14 of adjacent paths 10. Note that each step 14 contains one, and only one, movement arrow 22 to one step 14 on each path adjacent to it. By following the movement arrows 22, a route from each step must be provided to one, and only one, other step on each and every other path 10. To demonstrate this: in FIG. 2, the course 50 follows movement from the purple path to the blue path. The sequence of steps from "p2" to "r3" to "g3" to "o3" to "b3" is the only sequence possible (following the movement arrows) from "p2" to the blue path. Each step 14 may have more than one bordering step on the adjacent path. This provides an option as to which bordering step can be linked. An example is shown in FIG. 1 where step "b5" has a movement arrow leading to "o5". Alternatively, "b5" could be linked to "o4" in movement to the orange path. This would be accomplished by providing a movement arrow from "b5" into the overlapping portion of "o4". The manner of linking adjacent steps is preferably not uniform over the path length. The set of paths 10 and movement arrows 22 define a multitude of courses of various length which may be followed from the starting point to the ending point. This variability in board layout results in an element of skill and tactics during play in recognizing optimum courses through the particular linking elements and paths.

For each path 10 there is provided an associated deck 30 of cards 32 having a matching indicia 34 on one face. All the second faces of all cards 32 have the same image so as to not reveal the card suit or rank to opposing players during play. The seven decks 30 may all contain the same number of cards 32 or may contain varying numbers of cards 32 as shown. In the embodiment shown, the decks 30 have the number of cards 32 provided in Table 1 (a reduced number of cards per deck is shown in FIG. 1 for simplicity):

TABLE 1

| Suit or Indicia | Number of cards |
|---|---|
| k (black) | 7 |
| w (brown) | 14 |
| p (purple) | 14 |
| r (red) | 21 |
| g (green) | 21 |
| o (orange) | 28 |
| b (blue) | 28 |

The cards of each deck have a second indicia, on the same side as the first indicia 34, indicating a rank from one to seven. The decks contain even multiples of seven cards in order to make up complete sequences of rank from one to seven. A chance device in the form of seven dice 40 are also provided. The faces 42 of the dice have indicia 44 matching the suits of the decks 30 and paths 10. The 42 faces of the dice 40 contain the quantity of indicia in Table 2 for each suit:

TABLE 2

| Path Indicia or Suit | Total Number of Dice Faces |
|---|---|
| k | 3 |
| w | 4 |
| p | 5 |
| r | 6 |
| g | 7 |
| o | 8 |
| b | 9 |

The faces 42 are marked such that a maximum of three faces, and a minimum of zero, for each suit may result from a roll of all the dice. Note that the dice therefore are not all the same.

The methods of play will now be discussed with respect to the game pieces shown in FIG. 1 and described above.

The objective of play is for each player to traverse a course 50 (FIG. 2) through the paths 10 from the start point 16 to the ending point 18. There are a great many courses which may be followed through the paths 10 and movement arrows 22. Preferably, a game piece is used to indicate the position of each player on the game board 12. In this embodiment of the game, from two to seven players may participate at a time. At the initiation of play, each deck 30 is shuffled by itself and placed on the game board 12. The smallest deck is used to determine the starter: each player draws 1 card from this deck, the player drawing the highest ranking card being the starter. A playing set is formed by drawing a number of cards from each deck according to Table 3:

TABLE 3

| Suit or Indicia | Number of cards |
|---|---|
| k | 2 |
| w | 4 |
| p | 6 |
| r | 8 |
| g | 10 |
| o | 12 |
| b | 14 |

A total of 56 cards make up the playing set. The remaining undrawn cards in each deck make up seven reserve decks which are retained on the playing board 12. The playing set is then shuffled and dealt out to the players one at a time, face down, until each player has seven cards. The starter selects a "trump" or dominant suit of cards. The starter player then rolls the seven dice 40. The number of upturned dice faces showing the selected trump suit are counted and this number of cards are drawn by the starter from the reserve deck of trump suit cards. The starter must discard an equal number of cards from his hand of cards. These cards are added to the cards remaining in the playing set. If during subsequent hands, the reserve deck contains no cards, the player obtains no cards from the reserve deck.

The play of the cards to form tricks will now be described. The starter reveals a card from his hand. The other players in turn each reveals or "plays" a card from their respective hands of cards. Each player must play a card of the suit played by the starter, if possible. If a player does not possess a card of this lead suit, he may play any other card in his hand. After each player has played one card, the winner of the "trick" is determined by the player of the highest card of the suit led by the starter. If a trump card is played, the highest trump card wins, regardless. Between identical cards played by different players, the first card played wins. The winner of the trick leads play for the next trick. Tricks are played until all cards dealt out are played. At the end of each hand, movement of the players through the paths is determined by the number of tricks won by the starter. In order for the starter to move, the starter must win at least a predetermined minimum number of tricks in a hand. The minimum tricks are as provided in Table 4 below:

TABLE 4

| Number of Players | Minimum # of Tricks to Move |
|---|---|
| 2 players | 5 tricks (no dice) |
| 3–5 players | 4 tricks |
| 6–7 players | 3 tricks |

If the starter wins exactly the minimum, he moves one step or space along the trump path. The trump path is that path associated with the card deck having the trump indicia. For each trick over the minimum, the starter moves another space along the trump path. If the starter does not make at least the minimum number of tricks above, the remaining players instead each move the number of tricks below the minimum number of tricks. In this manner the starter is pitted against the remaining players. For example, in a game of four players, the minimum number of tricks the starter must win to move is four. If he wins four, he moves one space. If he wins five tricks, he moves two (1+5−4=2) spaces. If he wins only three tricks, the other players move one space each. If the starter only wins two tricks, the other players move two spaces each. After each hand, another player is selected in order to be starter for the next hand. In this case, the next starter is the person to the left of the previous starter (moving clockwise). Prior to each hand, all cards of the playing set are combined and reshuffled. Hands are played, with the players in turn acting as starter, until one or more players reach the ending point. Winners from players who reach the ending point simultaneously are determined by the starter dealing out seven cards from the shuffled playing set to each tied player. The starter turns up the top card to name trump and then turns up the next card to be taken as a trick. The cards are played as above and the player with the most tricks wins.

In order to move along the trump path as described above, a player may first have to move to the trump path. As a result of prior movements, a player may be on any of the paths. In order to move along a different path he must first move to that path by following the movement arrows. To demonstrate movement among paths an exemplary series of hands will be explained with reference to FIG. 2. Initially all players (in this example 4) are at the start point 16. In the first hand the starter wins only two tricks which is two below the minimum of four from Table 4. The teamed players opposing the starter therefore each move two steps. If the trump suit is purple, the teamed players move along a course 50 following the purple path. On the following hand, the starter will be one of the previous teamed players; while the other teamed players now teamed with the previous starter. If in this second hand the new starter wins six tricks in the blue trump suit, he will move to the outer blue path following the movement arrows as shown to "b3". He then progresses three steps along the blue path to "b6". The remaining players are left behind on "p2" and the start 16. If, instead, the starter wins only one trick, the teamed players on "p2" follow the course just described to "b6" while the teamed player (previous starter) at the starting point 16 progresses three steps on the blue path following a different course 54 to "b3" as shown. The new starter remains on "p2". This demonstrates the value of skill during play in selecting trump to take advantage of player position. The "fastest" path is not always the shortest path, but may be the path incorporating the most advancing shift to reach it. The probability of movement on a particular path must also be incorporated in selecting the proper play. This may involve knowledge of the particular set of cards in play—the knowledge gained from previous hands. On this particular board, moving two steps along the purple path and then switching to the blue path is faster than attempting to move straight up the blue path. While some courses through the paths are shorter than others, a winning course for a player must also take into account the movement and relative position of the other players at each point of play. This also demonstrates the significance of teaming of the nonstarters. Teamed players will inevitably at times move from different paths to progress along the same path at different steps. This teaming, in combination with the unique path structure, provides a surprising and complex skill element. If a first player is teamed with a second player who is nearer the finish point, it may be the best tactic for the first player to intentionally lose the hand. A starting player recognizing a losing hand may most beneficially choose a less advantageous dominant suit to advance the other players.

The present board game elements and methods of play are not limited to the specific examples provided above. The particular game elements and play methods described have been found to have a excellent blend of skill opportunities, luck and playability. There are other variations also following the novel concepts of the invention. The paths and path steps of FIG. 1 are contiguous and aligned in an adjacent side-to-side fashion. Other variations exist wherein neither the individual steps of each path, nor the paths themselves are physically or spatially joined. The paths may be, for example, a sequence of steps placed apart in three dimensions. However, in that configuration the order of steps in a path and the linking of paths must be provided on each step or in some other manner. One advantage of the paths and board as shown in FIG. 1 is that its characteristics are easily viewed and understood. The steps of adjacent paths overlap in an offset manner allowing for simple graphical depiction of the movement arrows. The shape of the paths need not be semi-circular, although this shape results in a simple starting point 16 and ending point 18 and simplified means of displaying the linking elements as movement arrows. The linking elements may also be in the form of matching indices on the linked steps or other directional indicators. Alternatively, the game may use a serpentine or three-dimensional shaped game board. The game is best played with about seven paths as shown. This provides a game board having courses with sufficient complexity to be not quickly understood, adding skill to the play. Also, because there must be a deck associated with each path, the number of cards in play is linked to the number of paths. A greater or lesser number of paths may be used, but the number of cards in each deck must be adjusted, in part to provide a proper number of cards in the playing set. Similarly, the number of steps in the paths may be greater or lesser than those shown in the Figures.

Figure 3:
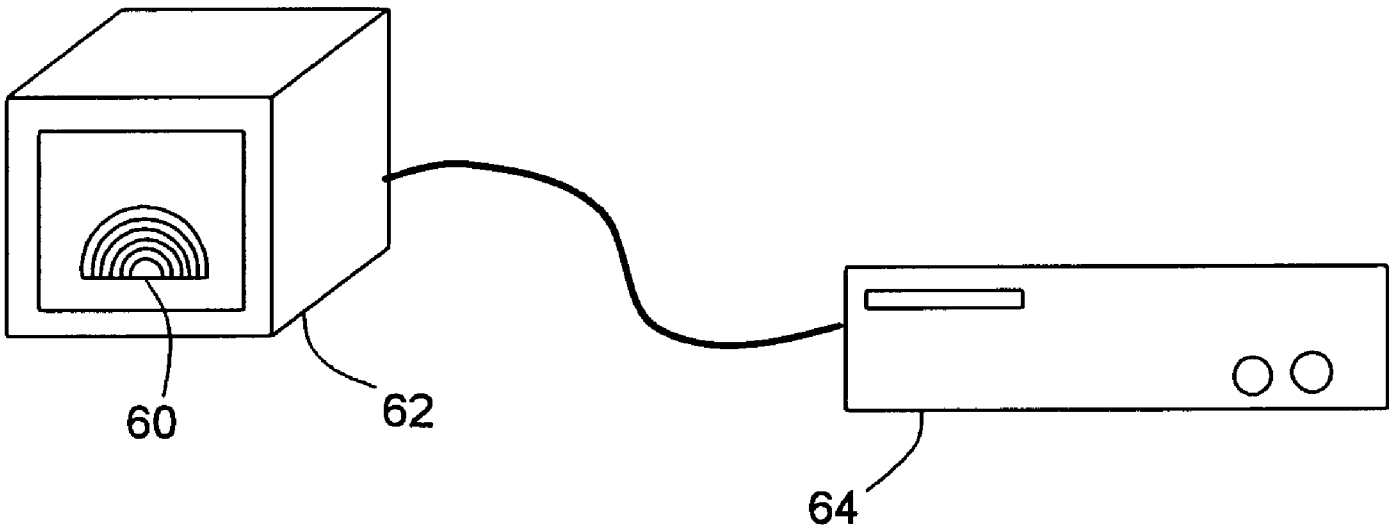
FIG. 3 depicts a computer implementation of the present game.

In another alternative embodiment, the paths 60 are elements of a computer display device 62 as shown in FIG. 3. Other elements of the game including the chance device and playing elements are functionally provided by a computer processing unit 64 and display devices 62. In one embodiment, the computer processing unit 64 is used to change the arrangement of the linking elements such as to alter the characteristics of the courses and game board. Methods of implementing the methods of play and game elements with a computer are available and well known in the art. Other devices may be used to form the various elements of the game. It will be obvious to one skilled in the art to substitute other devices for the playing cards of the shown embodiment.

In the embodiment of FIG. 1, the seven decks 30 contain varying numbers of cards 32. These particular numbers help to provide, in combination with the path lengths and the number of playing cards from each suit, relatively even probabilities of winning sufficient tricks to allow movement in each path. However, alternatively, the decks may have the same number of cards, or other combinations. These alternatives will have different probabilities of movement in the paths. Knowledge of these varying probabilities add additional skill elements to the game. However, for playability, the probability of movement along each step should not differ too greatly for playability. Too disparate probability between paths will result in a simplifying of the game as the "slow" paths will be ignored in play. Similarly, the dice configuration described above provide a balance of probabilities which has been found to be beneficial to the playability of the game. Other configurations are possible. The overall probability of moving a number of steps on a particular path is a function of a combination of several game elements including: 1) the number of cards of the associated deck in play (the more cards, the more chance of accumulating tricks as trump suit), 2) the particular rank of the of the cards in the playing set (because the playing set is a subset of the complete suit decks, the particular cards in play will vary and subsequently so will the chance of winning with a particular hand), 3) the number of dice and dice face with the suit indicated (the probability of winning with a suit is increased as the number of that suit held is increased through use of the dice). Other elements such as the minimum tricks to move also have an effect on probability. It is not necessary that the probabilities of movement on each path be exactly proportional to the number of steps. However, if the combined length and probability of movement is not similar within the paths, playability will suffer as previously discussed. The number of cards in the playing set limits the number of players. In alternative embodiments, the decks and playing sets provide additional cards to allow a greater number of players.

I claim:

1. A novel game of chance and skill, comprising:

a plurality of paths, each of the paths being formed of a sequence of a predetermined number of steps; and each step having a linking element linking the step to at least one other step in a different path;

a plurality of decks, each of the decks being associated with one of the plurality of paths, and being formed of a predetermined quantity of playing elements, the quantity being relatively proportional to the number of steps in the associated path; each of the playing elements in each of the decks having a rank;

such that a multitude of playing courses may be defined by following a sequence of steps and linking elements.

2. The game of claim 1, wherein:

each of the paths has a different predetermined number of steps than each other path.

3. The game of claim 2, wherein:

each of the paths is a contiguous sequence of two-dimensional graphics formed on a flat game board, and all of the paths are aligned in adjacent side-to-side fashion and having a common starting point and common ending point.

4. The game of claim 3, wherein:

the path graphics are formed in a semicircular configuration with adjacent steps of mutually adjacent paths being positionally offset, and each linking element is at least one graphical movement arrow.

5. The game of claim 4, wherein:

the playing elements are playing cards.

6. The game of claim 5, wherein:

the number of playing cards in each deck is a multiple of seven.

7. The game of claim 6, further comprising:

a chance device comprising a set of dice, each face of each dice having an indicia associated with a path.

8. The game according to claim 7, wherein:

the plurality of decks comprises seven decks.

9. The game of claim 8, wherein:

the seven decks include:

a first deck having 7 playing cards, a second deck having 14 playing cards, a third deck having 14 playing cards, a fourth deck having 21 playing cards, a fifth deck having 21 playing cards, a sixth deck having 28 playing cards, a seventh deck having 28 playing cards.

* * * * *